US010697189B2

(12) United States Patent
Sekiyama et al.

(10) Patent No.: US 10,697,189 B2
(45) Date of Patent: Jun. 30, 2020

(54) CONNECTOR FOR TEMPORARY SCAFFOLDING

(71) Applicant: NIKKEN LEASE KOGYO CO., LTD., Tokyo (JP)

(72) Inventors: Tadakatsu Sekiyama, Tokyo (JP); Tetsuro Okada, Tokyo (JP); Sohei Wada, Tokyo (JP); Masaki Ito, Tokyo (JP); Hirofumi Sasaki, Tokyo (JP); Shinobu Sato, Tokyo (JP); Hazuki Shinohara, Tokyo (JP)

(73) Assignee: NIKKEN LEASE KOGYO CO., LTD., Tokyo (JP)

( * ) Notice: Subject to any disclaimer, the term of this patent is extended or adjusted under 35 U.S.C. 154(b) by 0 days.

(21) Appl. No.: 16/522,081

(22) Filed: Jul. 25, 2019

(65) Prior Publication Data

US 2019/0345725 A1 Nov. 14, 2019

Related U.S. Application Data

(63) Continuation of application No. PCT/JP2017/002964, filed on Jan. 27, 2017.

(51) Int. Cl.
*E04G 7/32* (2006.01)

(52) U.S. Cl.
CPC ..... *E04G 7/32* (2013.01)

(58) Field of Classification Search
CPC .. E04G 7/00; E04G 7/02; E04G 7/307; E04G 7/32; E04G 7/34; E04G 5/00
See application file for complete search history.

(56) References Cited

U.S. PATENT DOCUMENTS 3,420,557 A * 1/1969 Francis ..... E04G 1/15 403/256
4,180,342 A * 12/1979 Layher ..... E04G 1/14 403/24

(Continued)

FOREIGN PATENT DOCUMENTS

CN 2160702 Y 4/1994
CN 201326272 Y 10/2009

(Continued)

OTHER PUBLICATIONS

Korean Office Action, dated Dec. 27, 2019, in counterpart Korean Patent Application No. 10-2019-7025000, Total of 14 pages.

(Continued)

*Primary Examiner* — Daniel J Wiley
(74) *Attorney, Agent, or Firm* — Tracy M Heims; Apex Juris, pllc.

(57) ABSTRACT

A connector for temporary scaffolding at an end of a lateral member, to be wedge-connected to a receiver around a strut, includes: a wedge body provided movably at the end of the lateral member upward and downward relative to the lateral member; a locking body including a claw formed such that, as a result of the wedge-body's moving downward, the claw could travel from initial to locking position with respect to the receiver; and a biasing body capable of pressing the locking body toward the wedge body, wherein the wedge body includes a shoulder protruding toward the locking body, the locking body includes an interfering portion protruding toward the wedge body, and when the claw is at the initial position, the shoulder is blocked by the interfering portion from moving upward, thereby preventing the wedge body from moving upward and the locking body from traveling toward the biasing body.

7 Claims, 8 Drawing Sheets

(56) References Cited

U.S. PATENT DOCUMENTS 4,273,463 A * 6/1981 Dobersch ..... E04G 7/307 182/186.8
4,493,578 A * 1/1985 D'Alessio ..... E04G 7/307 403/49
4,595,077 A * 6/1986 Buttgereit ..... E04G 7/307 182/186.8
4,840,513 A * 6/1989 Hackett ..... E04G 7/307 182/186.8
4,958,702 A * 9/1990 Langer ..... E04G 7/307 187/406
5,078,532 A * 1/1992 Williams ..... E04G 7/308 182/186.8
5,207,527 A * 5/1993 Duncan ..... E04G 7/307 182/186.8
5,217,314 A * 6/1993 Perruelle ..... E04G 7/307 182/186.8
5,411,113 A * 5/1995 Lubinski ..... E04G 7/22 182/186.7
5,605,204 A * 2/1997 Ausejo ..... E04G 7/307 182/186.7
5,868,223 A * 2/1999 Lubinski ..... E04G 7/307 182/179.1
5,961,240 A * 10/1999 Bobrovniczky ..... E04G 7/307 182/186.8
6,027,276 A * 2/2000 Schworer ..... E04G 7/307 403/49
2009/0301815 A1* 12/2009 Rogers ..... E04G 1/06 182/178.1
2011/0180350 A1* 7/2011 Thacker ..... E04G 7/307 182/186.8
2011/0262215 A1* 10/2011 Thacker ..... E04G 7/307 403/81
2012/0186911 A1* 7/2012 Thacker ..... E04G 7/307 182/186.8

FOREIGN PATENT DOCUMENTS

| | | | |
|---|---|---|---|
| CN | 103255910 | A | 8/2013 |
| JP | 2011-140769 | A | 7/2011 |
| JP | 5264008 | B1 | 8/2013 |
| JP | 2015-55057 | A | 3/2015 |
| JP | 3123197 | U | 3/2015 |
| WO | PCT/JP2017/002964 | A1 | 8/2018 |

OTHER PUBLICATIONS

Chinese First Office Action, dated Jan. 13, 2020, in counterpart Chinese Patent Application No. 201780084721.7, Total of 6 pages.

* cited by examiner

CONNECTOR FOR TEMPORARY SCAFFOLDING

CROSS REFERENCE TO RELATED APPLICATIONS

This is a continuation application of International Patent Application No. PCT/JP2017/002964 filed on Jan. 27, 2017, of which full contents are incorporated herein by reference.

BACKGROUND OF THE INVENTION

Field of the Invention

The present invention relates to a connector, which is to be provided at an end of a lateral member, to be wedge-connected to a receiver provided around a strut, thereby forming a temporary scaffolding.

Description of the Background Art

In fabricating a temporary scaffolding in a construction site or the like, in order to connect a lateral member such as a handrail or laterally-suspension member between struts arranged at a predetermined interval, Applicant has made an invention described in Patent Document 1 shown below as a connector device to be provided at an end of the lateral member.

As to a connector device described in Patent Document 1 shown in FIG. 7, a worker has inserted a plug body (a) into an insertion opening of a receiver (x1) in a flange shape provided around a strut (x) (left-hand side with "(a)" of FIG. 7), and hit a first locking member (b) on the upper end through the use of a hammer so that a locking piece of a second locking member (c) could travel for locking at an insertion opening (x2) of the receiver (x1) by means of an elastic member (d) and a wedge mechanism inside the device, and thereby connected a lateral member (y) to the strut (x) (right-hand side with "(b)" of FIG. 7).

A protruding step portion (e) for interfering with a lower end of the second locking member (c) has been provided in the vicinity of a lower end of the first locking member (b). Such a portion has been provided, for removal of the connector device from the receiver (x1) of the strut (x), in order that the first locking member (b) could not easily be ejected upward from the plug body (a), when being hit on the lower end from below through the use of a hammer so as to release the second locking member (c) from a locking state.

PRIOR ART DOCUMENTS

Patent Documents

Patent Document 1: Japanese Patent No. 5264008

PROBLEMS TO BE SOLVED

As to the connector device described in Patent Document 1, however, there have been concerns that, in case an amount of force of hitting the first locking member (b) is excessively large, the locking piece would be deformed or destroyed due to having contact with the protruding step (e).

There have also been concerns that, in case an amount of hitting force of a hammer is excessively large when causing the second locking member (c) to travel further upward from an initial position, a protruding portion of the first locking member (b) would press a facing surface of a protruding portion of the second locking member (c), and as a result, the second locking member (c) would be caused to retract, and the first locking member (b) would be ejected upward in an unintentional fashion.

For an actual product as shown in FIG. 8, therefore, in order to avoid ejection of the first locking member (b) more reliably, an ejection-prevention rivet (f) has been provided at the lower end of the first locking member (b) in an auxiliary fashion.

Due to the provided rivet (f), however, it has been necessary to cut the rivet (f) through the use of a grinder when disassembling the connector device into the members for maintenance, which has caused an increase in labor and effort in a disassembling work.

SUMMARY OF THE INVENTION

In view of the above-described problems, there is provided the present invention whose objective is to provide means capable of preventing ejection of a member when the means is released from connection as well as facilitating removal of a member when the means is disassembled.

MEANS FOR SOLVING PROBLEMS

A first aspect of the present invention made to solve the above-described problems is a connector for temporary scaffolding to be provided at an end of a lateral member, the connector to be wedge-connected to a receiver provided around a strut, thereby forming a temporary scaffolding, the connector characterized by comprising: a wedge body provided at the end of the lateral member so as to be movable upward and downward relative to the lateral member; a locking body including a claw formed such that, as a result of the wedge-body's moving downward, the claw could travel from an initial position to a locking position with respect to the receiver; and a biasing body capable of pressing the locking body toward the wedge body, wherein the wedge body includes a shoulder protruding toward the locking body, the locking body includes an interfering portion protruding toward the wedge body, and when the claw is at the initial position, the shoulder is blocked by the interfering portion from moving upward, thereby preventing the wedge body from moving upward and the locking body from traveling toward the biasing body.

Further, a second aspect of the present invention is the connector for temporary scaffolding, in the above first aspect, characterized in that the shoulder includes an upper surface and a base, of which the upper surface is in a horizontal position or in a position of being inclined downward toward the base, and the interfering portion includes a lower surface with at least a part capable of having surface-contact with the upper surface of the shoulder when the claw is at the initial position.

Still further, a third aspect of the present invention is the connector for temporary scaffolding, in the above first or second aspect, characterized in that the interfering portion includes a guiding surface having a chamfered corner defined between a distal end surface and a lower surface of the interfering portion.

Still further, a fourth aspect of the present invention is the connector for temporary scaffolding, in any one of the above first to third aspects, characterized in that the wedge body includes, at a surface thereof facing a locking-body side: a first depression portion located, immediately above the shoulder; and a first overhanging portion located, immediately above the first depression portion, and the first overhanging portion presses the interfering portion toward the biasing body, as a result of the wedge-body's moving downward from a state when the claw is at the initial position, thereby resulting in a transition of the claw from the initial position to the locking position.

Still further, a fifth aspect of the present invention is the connector for temporary scaffolding, in any one of the above first to fourth aspects, characterized in that the wedge body includes, at a surface thereof facing a locking-body side: an inclined surface as a lower side of the shoulder; a step surface formed to extend below the inclined surface such that the inclined surface is stepped, toward a side opposite to the locking body with respect to the inclined surface, to provide the step surface; a joining surface joining the inclined surface and the step surface; and a first protruding portion defined by the inclined surface and the joining surface, the locking body includes: a first facing surface having contact with the inclined surface when the claw is at the initial position; a second facing surface having contact with the joining surface when the claw is at the initial position; a third facing surface having contact with the step surface when the claw is at the initial position; and a second protruding portion defined by the second facing surface and the third facing surface, and as a result of the wedge-body's moving downward from a state when the claw is at the initial position, the first protruding portion abuts on the second facing surface to press the locking body toward the biasing body, and thereafter, the inclined surface abuts on the second protruding portion to press the locking body toward the biasing body, thereby resulting in a transition of the claw from the initial position to the locking position.

Still further, a sixth aspect of the present invention is the connector for temporary scaffolding, in any one of the above first to fifth aspects, characterized in that the wedge body includes a protruding step portion engageable with a lower end of the claw in a state when the claw is at the initial position.

Still further, a seventh aspect of the present invention is the connector for temporary scaffolding, in any one of the above first to sixth aspects, characterized in that the locking body swings as a result of the wedge-body's moving downward from a state when the claw is at the initial position.

Still further, an eighth aspect of the present invention is the connector for temporary scaffolding, in any one of the above first to seventh aspects, characterized in that the biasing body is formed of an elastic member.

ADVANTAGEOUS EFFECTS OF THE INVENTION

According to the present invention, the advantageous effects shown below could be achieved.

(1) Wedge-body ejection could be prevented during release from connection.

In a state when the claw is at the initial position, upward movement of the wedge body and the retraction of the locking body could be prevented by means of a combination of the shoulder of the wedge body and the interfering portion of the locking body, and therefore, the wedge body is not ejected upward from an upper side even when the wedge body is hit on the bottom portion by an excessively large amount of force.

(2) Wedge-body removal, as necessary, could be facilitated.

During maintenance such as replacement of members, as a result of pushing the locking body in toward a biasing-body side through the use of a jig to release interference between the shoulder and the interfering portion, the wedge body could easily be removed from an upper side.

BRIEF DESCRIPTIONS OF THE DRAWINGS

DESCRIPTIONS OF EMBODIMENTS OF THE INVENTION

Hereinafter, an embodiment according to the present invention will be described with reference to the drawings.

It is to be noted that, in each of the drawings, a gap not inherently generated between members is occasionally shown in an exaggerated fashion for the purpose of clarifying their respective shapes.

EXAMPLES

Figure 1:
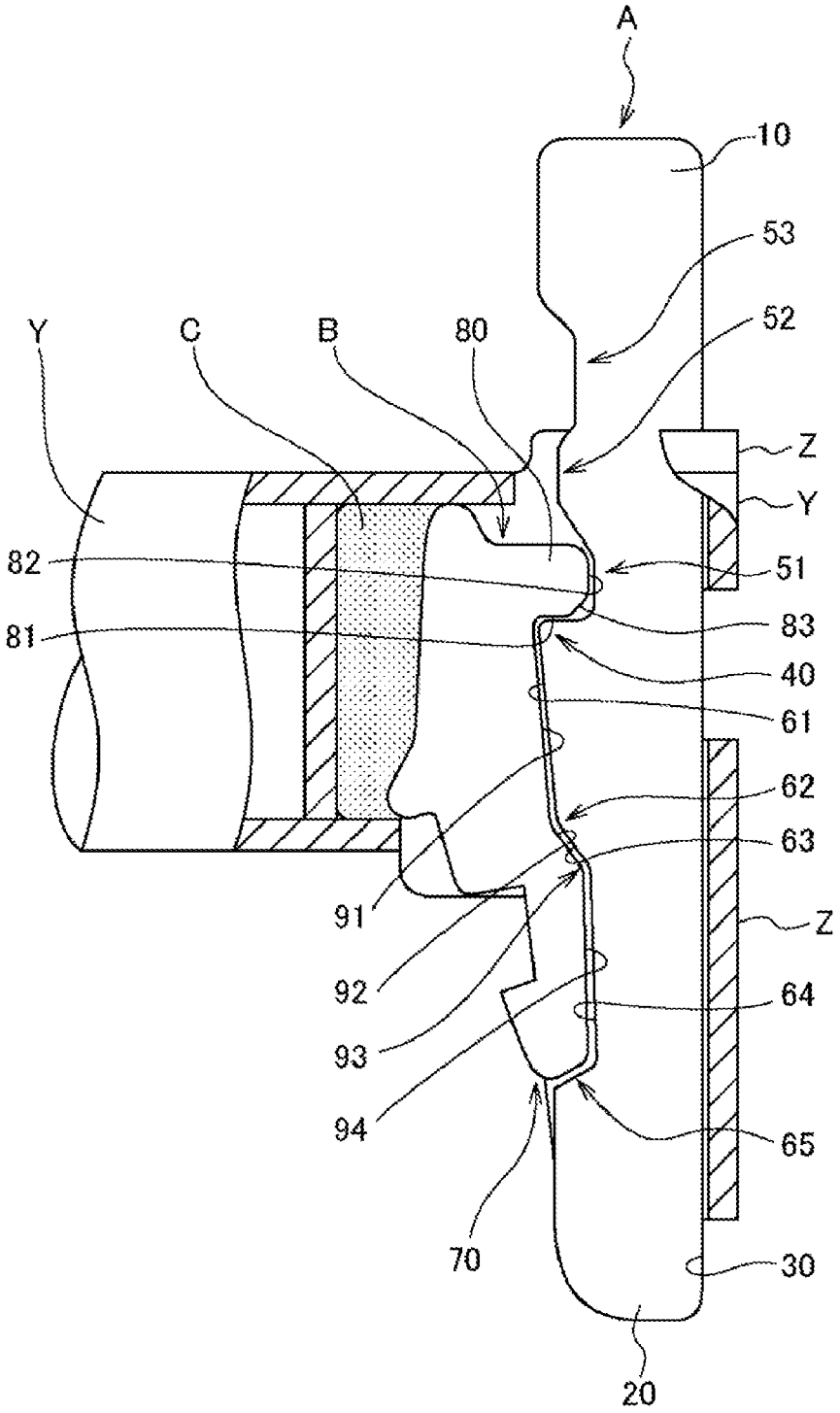
FIG. 1 depicts a partially-sectioned side view showing schematically a structure of members of a connector in an embodiment according to the present invention.

[1] Overall Configuration (FIG. 1)

FIG. 1 shows an embodiment of arrangement among members of a connector for temporary scaffolding (which will be, hereinafter, occasionally referred to as "connector" for short) in a state before wedge-connection (an initial state) according to the present invention.

A connector according to the present invention is a device provided at an end of a lateral member Y for being wedge-connected to a receiver X1 provided around a strut X thereby to form a temporary scaffolding, and arranged such that a wedge body A, locking body B, and biasing body C are inside an imaginary internal space of the end of the lateral member Y. Such a connector, in an embodiment according to the present invention, includes the wedge body A, locking body B, and biasing body C held substantially inside a holder space including: an internal space defined by the end of the lateral member Y in a cylindrical shape; and an internal space defined by a sheath body Z welded into a slit formed in a peripheral wall of the end of the lateral member Y.

Hereinafter, a detailed explanation will be provided for each member.

[2] Wedge Body (FIG. 1)

The wedge body A is a member for switching locking or not of the locking body B, which will be described later, as a result of the wedge-body (A)'s moving upward and downward.

Further, the wedge body A is held substantially inside the holder space so as to be slidable upward and downward.

Still further, the wedge body A has a head portion 10 and a bottom portion 20 both exposed from the sheath body Z and both capable of being hit by a hammer or the like.

Still further, the wedge body A is arranged, substantially inside the holder space, at such a position that the wedge body A at one side is adjacent to the locking body B and the wedge body A at the other side is adjacent to an inner wall of the sheath body Z.

[2.1] Embodiment at a Side Facing a Sheath-body Side

Firstly, the wedge body A has a sliding surface 30 formed at a side thereof facing a sheath-body (Z) side.

The sliding surface 30 in a flat shape is configured such that it is slidable with respect to the inner wall of the sheath body Z in a similar flat shape.

[2.2] Embodiment at a Side Facing a Locking-body Side

Secondary, the wedge body A has at least a shoulder 40 formed at a side thereof facing a locking-body (B) side.

In addition to the shoulder 40, the wedge body A in an embodiment according to the present invention further includes: a first depression portion 51; a first overhanging portion 52; and a second depression portion 53, in an upward order from the shoulder 40, and still further includes: an inclined surface 61; a first protruding portion 62; a joining surface 63; a step surface 64; and a protruding step portion 65, in a downward order from the shoulder 40.

[2.3] Shoulder

The shoulder 40 is a portion for preventing upward ejection of the wedge body A.

An upper surface of the shoulder 40 is in a horizontal direction (an axial direction of the lateral member Y) or is inclined toward a base side of the shoulder 40 as well as downward with respect to a horizontal direction.

Further, the upper surface of the shoulder 40 connects, from a free end thereof, downward to the inclined surface 61.

[2.4] First Depression Portion

The first depression portion 51 is a portion for receiving an interfering portion 80 of the locking body B in the initial state.

In an embodiment according to the present invention, an end surface of the first depression portion 51 is positioned at a further backward side (in an external direction from the end of the lateral member Y) than a free-end side of the shoulder 40.

[2.5] First Overhanging Portion

The first overhanging portion 52 is a portion for changing a position of the locking body B as a result of the wedge-body (A)'s moving downward.

In an embodiment according to the present invention, an end surface of the first overhanging portion 52 is positioned at a further backward side than a free-end side of the shoulder 40, and at a further forward side (in a closer direction to the biasing body C) than an end-surface side of the first depression portion 51.

[2.6] Second Depression Portion

The second depression portion 53 is a portion for changing a position of the locking body B as a result of the wedge-body (A)'s moving downward.

In an embodiment according to the present invention, an end surface of the second depression portion 53 is positioned at a further backward side than an end-surface side of the first overhanging portion 52, and at a further forward side (in a closer direction to the biasing body C) than an end-surface side of the first depression portion 51.

[2.7] Inclined Surface

The inclined surface 61 is a portion for changing a position of the locking body B as a result of the wedge-body (A)'s moving downward, and more specifically, it is a portion for changing an attitude of the locking body B such that a claw 70 of the locking body B travels to a locking position.

In an embodiment according to the present invention, the inclined surface 61 is formed to extend downward from a free end of the shoulder 40 toward a backward side.

[2.8] Joining Surface and First Protruding Portion

The joining surface 63 joins between the inclined surface 61 and the step surface 64.

In an embodiment according to the present invention, the joining surface 63 is formed such that an internal angle with respect to the inclined surface 61 and an external angle with respect to the step surface 64 are an obtuse angle to each other.

Therefore, the first protruding portion 62, defined between the inclined surface 61 and the joining surface 63, forms an internal angle as being an obtuse angle.

[2.9] Step Surface

The step surface 64 is a portion for securing a thickness of the claw 70 of the locking body B.

In an embodiment according to the present invention, the step surface 64 is formed, toward a backward side, to extend downward at a further backward side than an inclined-surface (61) side.

[2.10] Protruding Step Portion

The protruding step portion 65 is a portion for preventing upward ejection of the wedge body A along with the shoulder 40. In the present invention, such a protruding step portion 65 is not necessarily an essential element but configured to serve functions, in an auxiliary fashion, of the shoulder 40.

In an embodiment according to the present invention, an upper surface of the protruding step portion 65 is inclined toward a base side thereof connecting to the step surface 64 as well as upward with respect to a horizontal direction, and the upper surface connecting from a free end thereof, toward the bottom portion 20 of the wedge body A.

[3] Locking Body (FIG. 1)

The locking body B is a member for connecting between the strut X and the lateral member Y to be fixed to each other by traveling for locking at an insertion opening X2 of the receiver X1 provided around the strut X, as a result of the wedge-body (A)'s moving upward and downward.

The locking body B is arranged to extend over an internal space defined by the end of the lateral member Y, and an internal space defined by the sheath body Z, in such a fashion that the locking body B at one side is adjacent to the biasing body C, and the locking body B at the other side is adjacent to the wedge body A.

It is to be noted that a lock operation of the locking body B to lock at the receiver X1 is realized by: a retract operation of the locking body B to retract toward a biasing-body (C) side; a swing operation of the locking body B to swing toward a biasing-body (C) side; or a combination thereof, as a result of the wedge-body (A)'s moving downward; however, the lock operation is not limited, in particular, to the above.

[3.1] Claw

The locking body B has at least the claw 70 formed at a surface thereof facing a biasing-body (C) side.

The claw 70 is a portion for locking at the insertion opening X2 of the receiver X1 of the strut X to connect between the strut X and the lateral member Y.

Such a claw 70 is substantially hidden inside the sheath body Z in an initial position, and as a result of the wedge-body (A)'s moving downward, the claw 70 is pushed out by the wedge body A to be exposed from an opening of the sheath body Z so that the claw 70 is locked at a side wall of the insertion opening X2 of the receiver X1.

[3.2] Interfering Portion

The locking body B has at least the interfering portion 80 formed at a surface thereof facing a wedge-body (A) side.

The interfering portion 80 is a portion for preventing upward ejection of the wedge body A from an upper side of the sheath body Z.

Such an interfering portion 80 has a lower surface 81 having at least a part which capable of having surface-contact with the upper surface of the shoulder 40 when the claw 70 is at the initial position.

It is preferred that a thickness of the interfering portion 80 be as large as possible.

[3.2.1] Guiding Surface

The interfering portion 80 may include a guiding surface 83 having a chamfered corner defined between a distal end surface 82 and the lower surface 81 of the interfering portion 80.

The guiding surface 83 is not particularly limited in shape, and may be in a known shape such as a straight line shape, polygonal line shape, or curved line shape.

Such a guiding surface 83 is a portion for the purpose of removing the wedge body A in an intentional fashion. A detailed explanation thereof will be provided later.

[3.3] Facing Surfaces and Second Protruding Portion

In addition to the above, in an embodiment according to the present invention, the locking body B includes, at a surface thereof facing a wedge-body (A) side: a first facing surface 91, a second facing surface 92, and a third facing surface 94, in a downward order from the interfering portion 80.

Hereinafter, a detailed explanation will be provided for each facing surface.

[3.3.1] First Facing Surface

The first facing surface 91 is a portion having contact with the inclined surface 61 of the wedge body A in the initial state.

The first facing surface 91 is in a plain-surface shape and is substantially parallel to the inclined surface 61 in the initial state.

[3.3.2] Second Facing Surface

The second facing surface 92 is a portion having contact with the joining surface 63 of the wedge body A in the initial state.

The second facing surface 92 is in a plain-surface shape and is substantially parallel to the joining surface 63 in the initial state.

[3.3.3] Third Facing Surface and Second Protruding Portion

The third facing surface 94 is a portion having contact with the step surface 64 of the wedge body A in the initial state.

The third facing surface 94 is in a plain-surface shape and is substantially parallel to the joining surface 63 in the initial state.

Therefore, the second protruding portion 93 defined as a portion, at which the second facing surface 92 connects to the third facing surface 94, forms an internal angle between the second facing surface 92 and the third facing surface 94 as being an obtuse angle.

[4] Biasing Body (FIG. 1)

The biasing body C is a member for biasing the locking body B toward the wedge body A.

The biasing body C may be formed of a known elastically deformable material.

More specifically, the biasing body C is arranged so as to be compressed in a space defined between a side wall placed inside the end of the lateral member Y and the locking body B, and is configured to serve functions of constantly pressing the locking body B toward a wedge-body (A) side by a restoring force of the biasing body C from the side wall as a reaction-force point.

[5] Operation of Connecting to Strut (FIGS. 2 to 5)

Next, the arrangements for members of the connector in their respective stage-embodiments for use in an embodiment according to the present invention will be described.

Figure 2:
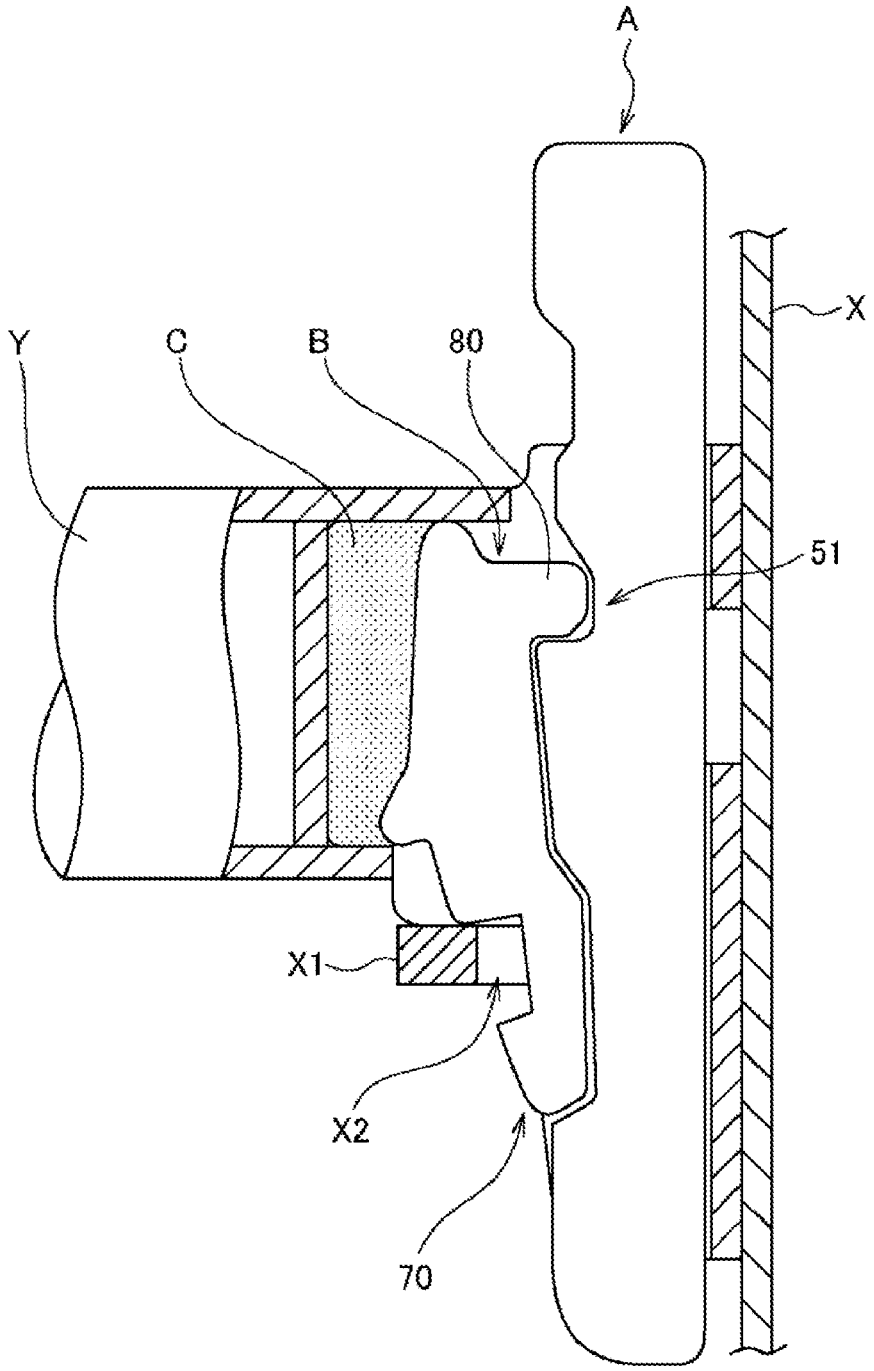
FIG. 2 depicts a partially-sectioned side view showing schematically a structural state of a connector inserted into a receiver of a strut in an embodiment according to the present invention.

[5.1] Initial State (FIG. 2)

FIG. 2 shows a state where the connector in an embodiment according to the present invention is inserted into the receiver X1 of the strut X.

In such a state, the interfering portion 80 of the locking body B is disposed on the shoulder 40 of the wedge body A, the first facing surface 91 is adjacent to the inclined surface 61, the second facing surface 92 is adjacent to the step surface 64, and the third facing surface 94 is adjacent to the joining surface 63. Further, the interfering portion 80 of the locking body B is received in the first depression portion 51 interposed between the first protruding portion and the shoulder 40 of the wedge body A.

Hence, as a result of having pressure-contact between the first overhanging portion 52 and the interfering portion 80, and pressure-contact between the second facing surface 92 and the joining surface 63, which are made by the locking body B biased toward a wedge-body (A) side, the wedge body A is supported by the locking body B, and therefore, the wedge body A does not fall down.

Further, the claw 70 of the locking body B is in a state where it remains at the initial position substantially without being exposed from the sheath body Z, and where the connector could be inserted into and extracted from the receiver X1 of the strut X.

Still further, the claw 70 of the locking body B is in a state where it does not have contact with the protruding step portion 65 of the wedge body A.

From this state, the wedge body A is hit on the head portion 10 to cause downward movement of the wedge body A to start.

Figure 3:
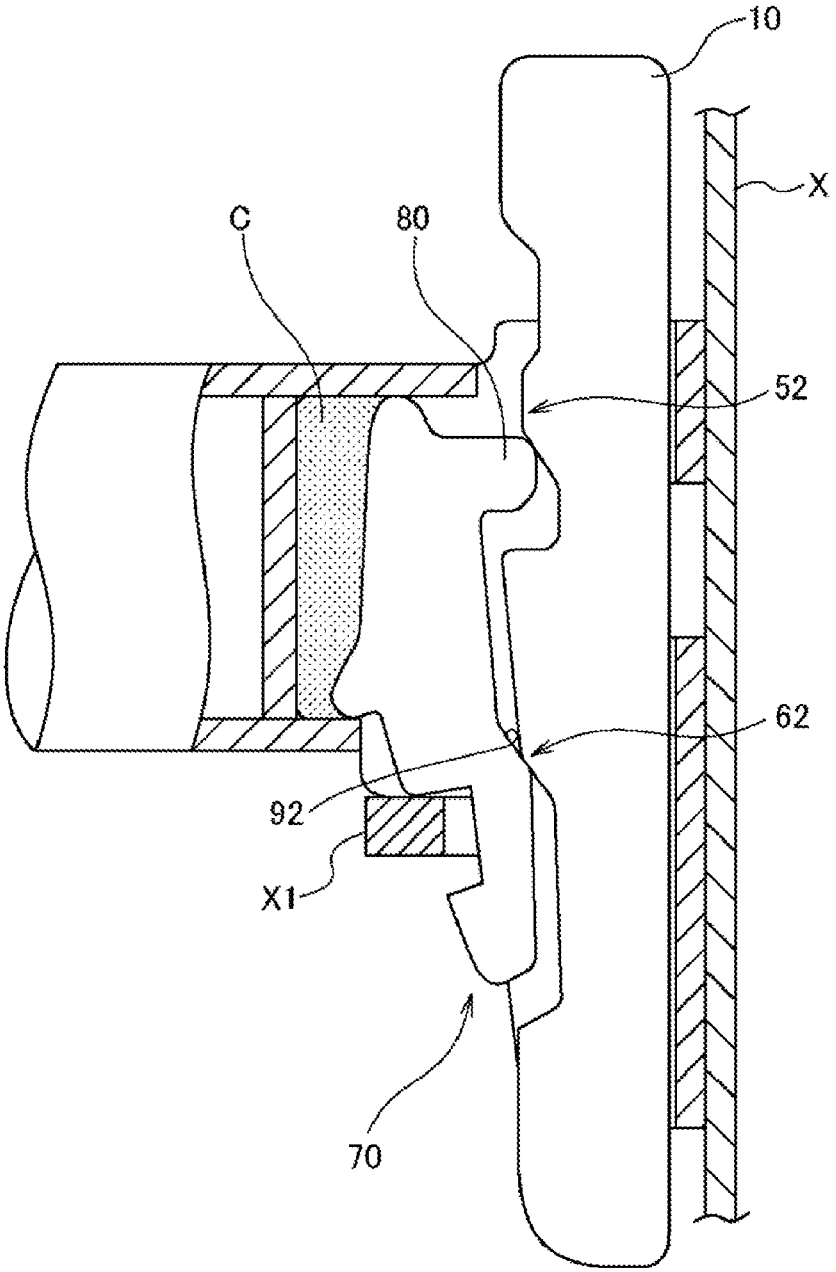
FIG. 3 depicts a partially-sectioned side view showing schematically a first state of members of a connector during downward movement of a wedge body.

[5.2] First Stage (FIG. 3)

FIG. 3 shows a state where the connector is in a first stage as a result of downward movement of the wedge body A.

Hereinafter, explanation of states of their respective portions will be provided with reference to FIG. 3.

[5.2.1] Pushing in By First Overhanging Portion

The interfering portion 80 of the locking body B received in the first depression portion 51 is gradually pushed in toward a biasing-body (C) side, by an inclined path of the wedge body A defined between the first depression portion 51 and the first overhanging portion 52, as a result of a wedge-body (A)'s moving downward.

[5.2.2] Pushing in By First Protruding Portion

In parallel with the above, the first protruding portion 62 defined between the inclined surface 61 and the joining surface 63 of the wedge body A abuts on the second facing surface 92 so as to push the locking body B in toward a biasing-body (C) side.

With the above-described operations, the claw 70 of the locking body B starts traveling toward the locking position where the locking body B is locked at the receiver X1. It is to be noted that traveling of the locking body B includes a retract operation, swing operation, or a combination thereof, of the locking body B.

Figure 4:
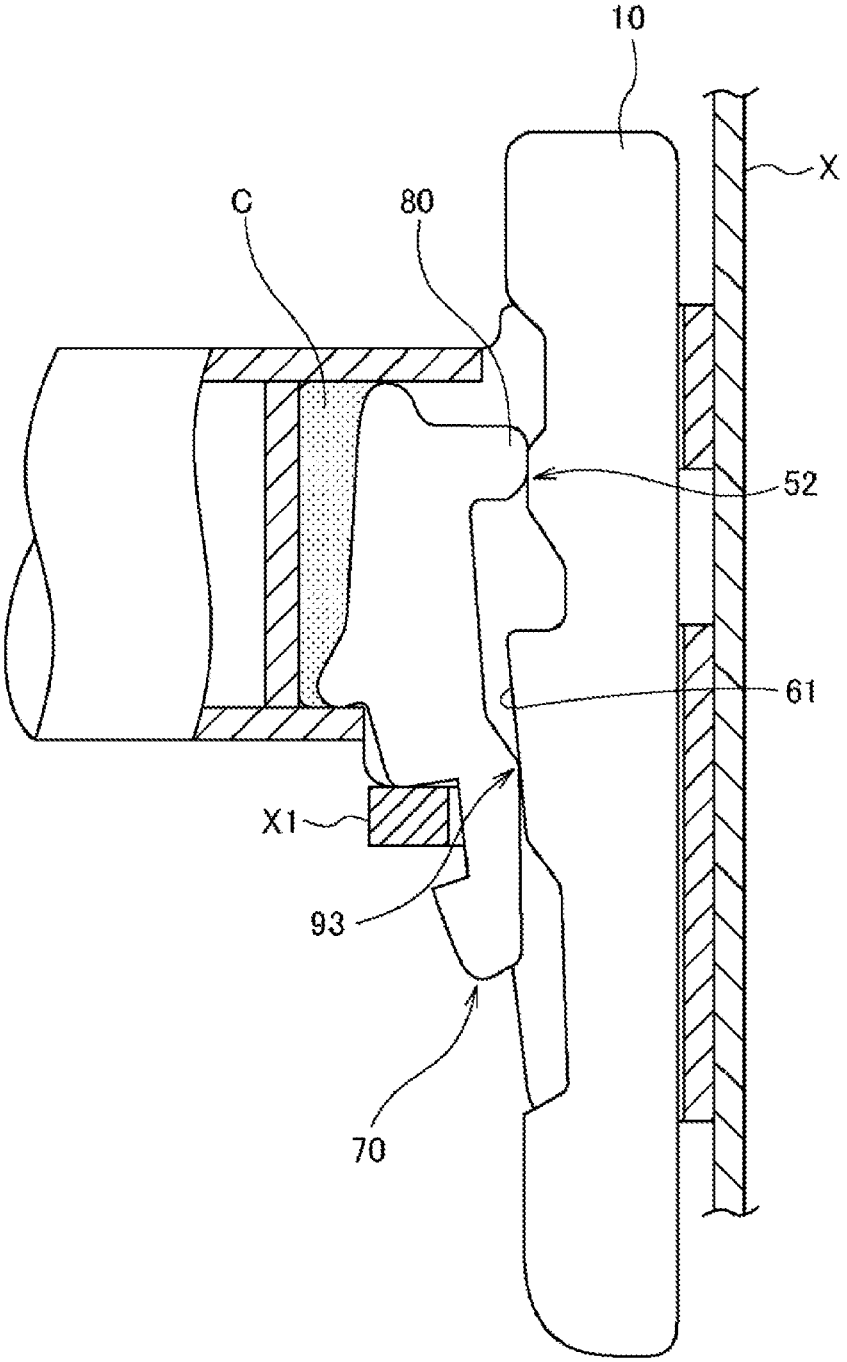
FIG. 4 depicts a partially-sectioned side view showing schematically a second state of members of a connector during downward movement of a wedge body.

[5.3] Second Stage (FIG. 4)

FIG. 4 shows a state where the connector is in a second stage as a result of downward movement of the wedge body A.

Hereinafter, explanation of states of their respective portions will be provided with reference to FIG. 4.

[5.3.1] Pushing in By First Overhanging Portion

The first overhanging portion 52 of the wedge body A arrives at a distal end of the interfering portion 80 of the locking body B.

[5.3.2] Pushing in By Inclined Surface 61

The second protruding portion 93 of the locking body B abuts on the inclined surface 61 of the wedge body A, and the locking body B is pushed in, through the second protruding portion 93 by the inclined surface 61, toward a biasing-body (C) side.

In such a fashion, the claw 70 transitions toward the locking position.

With the above-described operations, the claw 70 of the locking body B further transitions toward the locking position where the locking body B is locked at the receiver X1. It is to be noted that traveling of the locking body B includes a retract operation, swing operation, or a combination thereof, of the locking body B.

Figure 5:
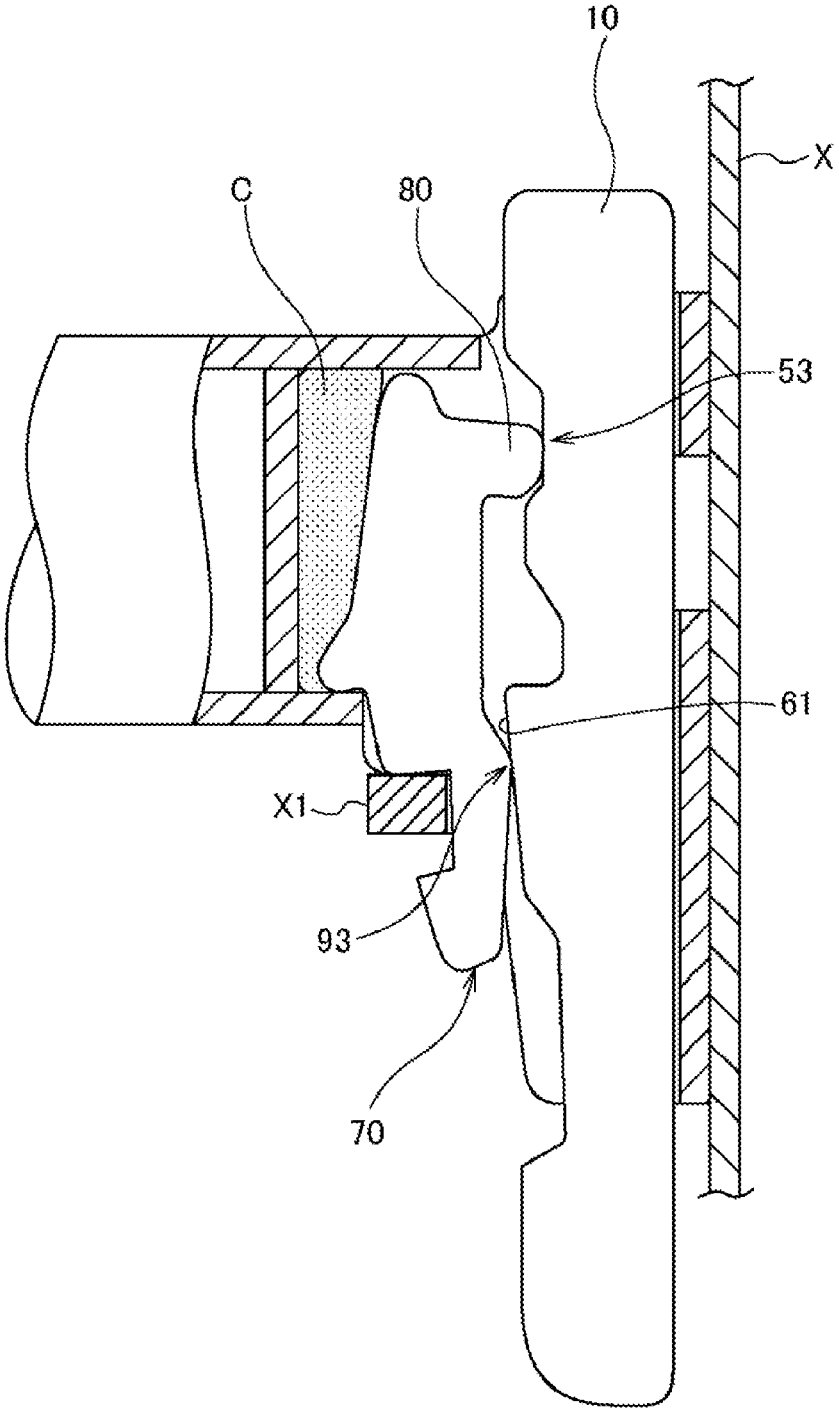
FIG. 5 depicts a partially-sectioned side view showing schematically a third state of members of a connector during downward movement of a wedge body.

[5.4] Third Stage (FIG. 5)

FIG. 5 shows a state where the connector is in a third stage as a result of downward movement of the wedge body A.

Hereinafter, explanation of states of their respective portions will be provided with reference to FIG. 5.

[5.4.1] Receipt of Interfering Portion in Second Depression Portion

The interfering portion 80 of the locking body B is pressed by an elastic force of the biasing body C toward a wedge-body (A) side so as to climb over the first overhanging portion 52 and be received in the second depression portion 53 of the wedge body A.

[5.4.2] Continued Pushing in By Inclined Surface

The second protruding portion 93 of the locking body B abuts on a further upper side of the inclined surface 61, in comparison with that in the previous stage, of the wedge body A, and subsequently, the locking body B is pushed in, through the second protruding portion 93 by the inclined surface 61, toward a biasing-body (C) side.

With the above-described operations, the claw 70 of the locking body B still further transitions toward the locking position where the locking body B is locked at the receiver X1 (locking state). Due to the effects that a lower part of the locking body B is pushed in by the inclined surface 61 as well as the interfering portion 80 is received in the second depression portion 53, in particular, the locking body B swings in a clockwise direction, and as a result, an operation for the claw 70 to travel toward the locking position, where the locking body B is locked at the receiver X1, is promoted.

Further, in such a state, a step from the second depression portion 53 to the head portion 10 located above the second depression portion 53 of the wedge body A is large to such an extent that there is not any further margin to compress the biasing body C, and for this reason, the wedge body A could no longer be caused to move downward even if it is hit on the head portion 10.

[5.5] Supplementary Explanation (Definition of Connection-completion State)

In the connector in an embodiment according to the present invention, it is assumed that locking at the receiver X1 would usually be completed in a state of the third stage associated with FIG. 5, and the connector would reliably be connected to the strut X. However, due to such a structure that a width of the insertion opening X2 of the receiver X1 is small, if the claw 70 of the locking body B is sufficiently locked at the receiver X1 even in an intermediate stage before arriving at the third stage, the connector could be regarded as being reliably connected to the strut X in such an intermediate stage (locking state).

In the present invention, therefore, the second depression portion 53 is not necessarily an essential element.

[6] Removal From Strut (FIGS. 5 to 2)

When the connector is removed from the strut X, the wedge body A may be hit on the bottom portion 20 upward through the use of a hammer or the like in such a fashion that the claw 70 returns to the initial position from the locking position.

[6.1] Wedge Body Ejection-prevention Mechanism (FIG. 2)

It is to be noted that, in a stage of returning to the initial state shown in FIG. 1, even when the wedge body A is further hit on the lower end of the wedge body A, the interfering portion 80 of the locking body B is still disposed on the shoulder 40 of the wedge body A, the wedge body A is prevented by the interfering portion 80 from moving upward, and the wedge body A is not be ejected upward.

Further, as described above, the claw 70 of the locking body B is in a state where it does not have contact with the protruding step portion 65 of the wedge body A, and therefore, it is not be destroyed by the protruding step portion 65.

More specifically, due to the effects that the upper surface of the shoulder 40 is in a horizontal direction or is inclined toward the distal end of the interfering portion 80 as well as downward with respect to a horizontal direction, while the lower surface 81 of the interfering portion 80 has contact with a certain projective length of the upper surface of the shoulder 40, even when the wedge body A is hit on the lower end to promote upward movement by some amount of force, such a force does not cause the locking body B to retract or travel in a counter-clockwise direction.

It is not necessary, therefore, to provide an ejection-prevention rivet or the like in the lower end of the wedge body A.

Figure 6:
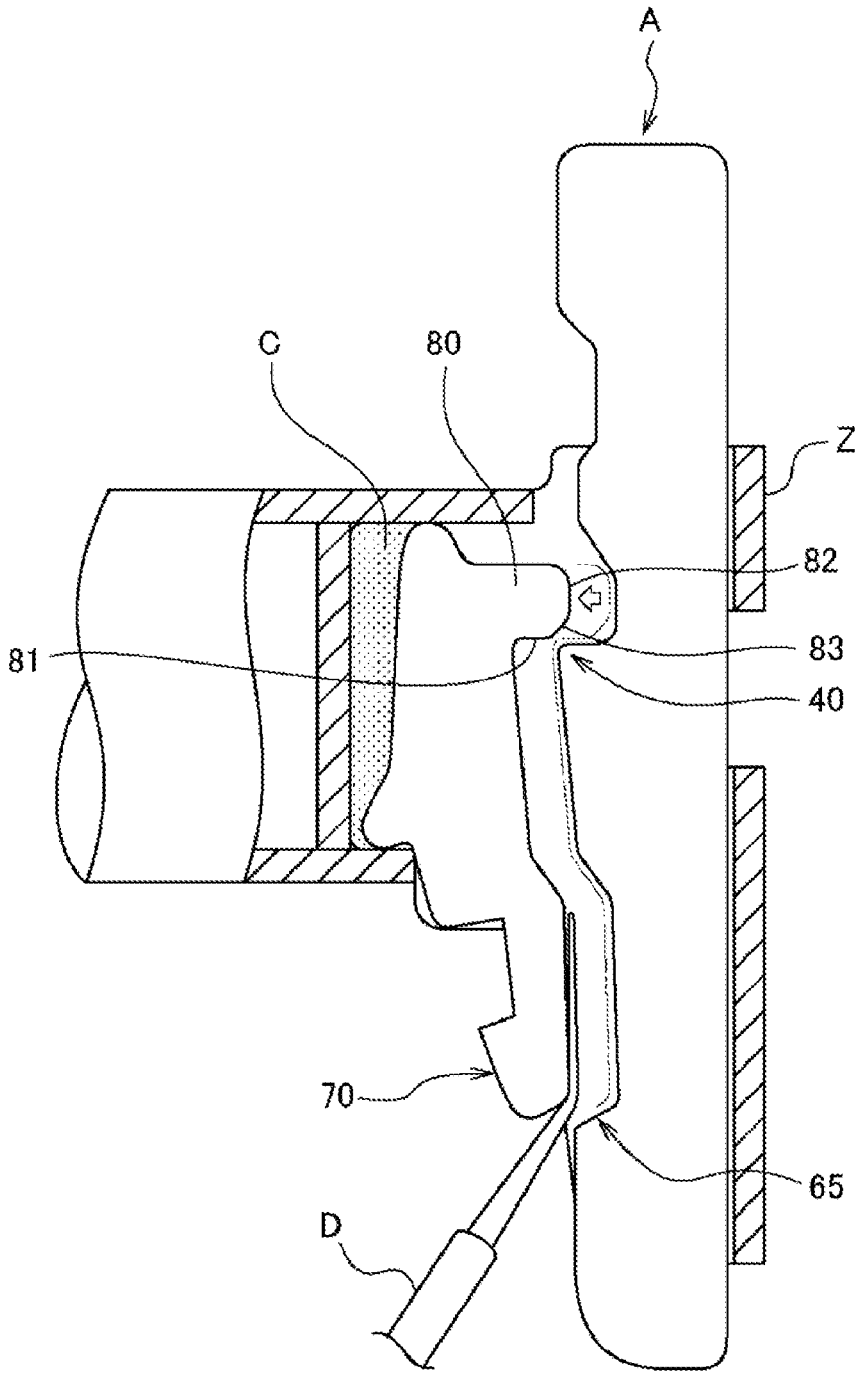
FIG. 6 depicts a partially-sectioned side view showing schematically a state of members of a connector when a wedge body is removed upward from an upper side.
Figure 7:
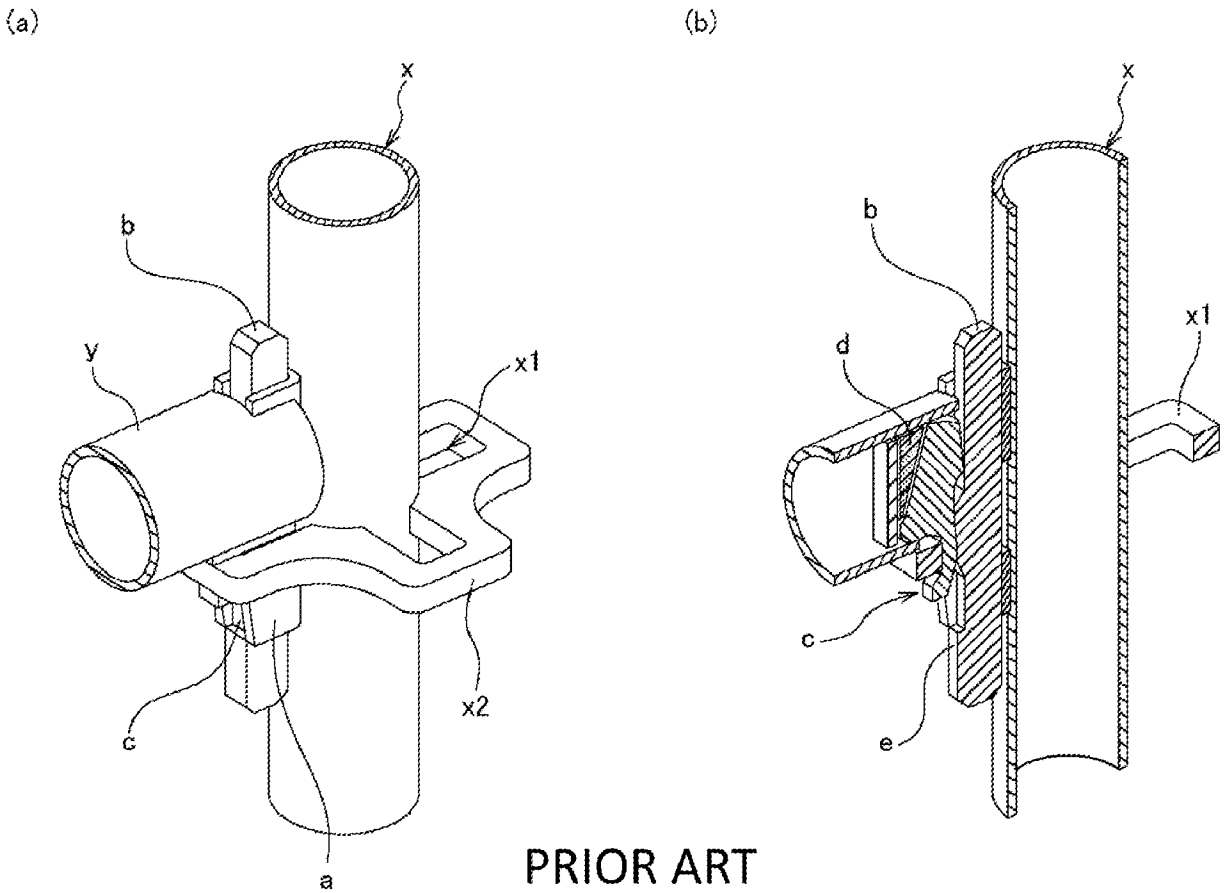
PRIOR ART FIG. 7
FIG. 7 depicts a perspective view (left-hand side with "(a)") and a cross sectional perspective view (right-hand side with "(b)") showing schematically initial/locking states of a connector device in prior art.
Figure 8:
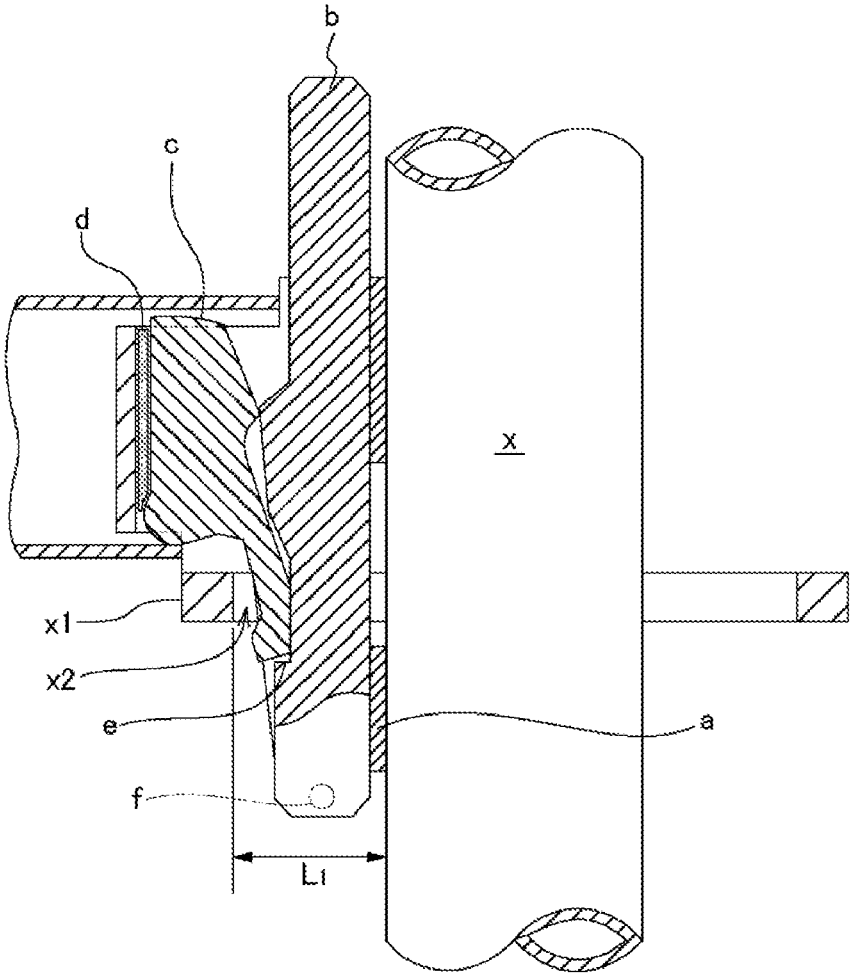
PRIOR ART FIG. 8
FIG. 8 depicts a cross sectional side view showing schematically an initial state of a connector device in prior art.

[7] Removal of Wedge Body (FIG. 6)

As described above, the wedge body A is not moved upward by a hit operation on the lower from a state shown in FIG. 1; however, it is preferred that the wedge body A be removed from the main body, if appropriate, for repair or the like.

In such a case, a jig insertable between the locking body B and the wedge body A is prepared, and the locking body B is forcibly caused to retract toward the biasing body C through the use of such a jig to release interference between the shoulder 40 and the interfering portion 80, and thereafter, the wedge body A is hit on the lower end, thereby the wedge body A could be removed from an upper side by being pulled upward.

Depending upon an insertion length of the jig, there are probabilities that the interference between the interfering portion 80 and the shoulder 40 would not be released sufficiently due to an insufficient retraction length of the interfering portion 80 even when the engagement between the protruding step portion 65 and the claw 70 could be released.

Even in such a case, when the interfering portion 80 includes the guiding surface 83 having the chamfered corner defined between the distal end surface 82 and the lower surface 81, and as a result, the interfering portion 80 could be caused to retract to such an extent that a chamfered corner of the shoulder 40 arrives at the guiding surface 83, retraction of the interfering portion 80 could be naturally promoted by hitting the wedge body A on the lower end, thereby the wedge body A could be removed from an upper side by being pulled upward.

REFERENCE NUMERALS

A Wedge body
10 Head portion
20 Bottom portion
30 Sliding surface
40 Shoulder
51 First depression portion
52 First overhanging portion
53 Second depression portion
61 Inclined surface
62 First protruding portion
63 Joining surface
64 Step surface
65 Protruding step portion
B Locking body
70 Claw
80 Interfering portion
81 Lower surface
82 Distal end surface
83 Guiding surface
91 First facing surface
92 Second facing surface
93 Second protruding portion
94 Third facing surface
C Biasing body
X Strut
X1 Receiver
X2 Insertion opening
Y Lateral member
Z Sheath body
A Plug body
B First locking member
C Second locking member
D Elastic member
E Protruding step portion
F Rivet
X Strut
x1 Receiver
x2 Insertion opening
y Lateral member

What is claimed is:

1. A connector for temporary scaffolding to be provided at an end of a lateral member, the connector to be wedge-connected to a receiver provided around a strut, thereby forming a temporary scaffolding, the connector comprising:

a wedge body provided at the end of the lateral member so as to be movable upward and downward relative to the lateral member;

a locking body including a claw formed such that, as a result of the wedge-body's moving downward, the claw could travel from an initial position to a locking position with respect to the receiver; and a biasing body capable of pressing the locking body toward the wedge body, wherein the wedge body includes a shoulder protruding toward the locking body, the locking body includes an interfering portion protruding toward the wedge body, and when the claw is at the initial position, the shoulder is blocked by the interfering portion from moving upward, thereby preventing the wedge body from moving upward and the locking body from traveling toward the biasing body, and wherein the wedge body includes, at a surface thereof facing a locking-body side:

an inclined surface as a lower side of the shoulder;

a step surface formed to extend below the inclined surface such that the inclined surface is stepped, toward a side opposite to the locking body with respect to the inclined surface, to provide the step surface;

a joining surface joining the inclined surface and the step surface; and a first protruding portion defined by the inclined surface and the joining surface, the locking body includes:

a first facing surface having contact with the inclined surface when the claw is at the initial position;

a second facing surface having contact with the joining surface when the claw is at the initial position;

a third facing surface having contact with the step surface when the claw is at the initial position; and a second protruding portion defined by the second facing surface and the third facing surface, and as a result of the wedge-body's moving downward from a state when the claw is at the initial position, the first protruding portion abuts on the second facing surface to press the locking body toward the biasing body, and thereafter, the inclined surface abuts on the second protruding portion to press the locking body toward the biasing body, thereby resulting in a transition of the claw from the initial position to the locking position.

2. The connector for temporary scaffolding according to claim 1, wherein the shoulder includes an upper surface and a base, of which the upper surface is in a horizontal position or in a position of being inclined downward toward the base, and the interfering portion includes a lower surface with at least a part capable of having surface-contact with the upper surface of the shoulder when the claw is at the initial position.

3. The connector for temporary scaffolding according to claim 1, wherein the interfering portion includes a guiding surface having a chamfered corner defined between a distal end surface and a lower surface of the interfering portion.

4. The connector for temporary scaffolding according to claim 1, wherein the wedge body includes, at a surface thereof facing a locking-body side:

a first depression portion located, immediately above the shoulder; and a first overhanging portion located, immediately above the first depression portion, and the first overhanging portion presses the interfering portion toward the biasing body, as a result of the wedge-body's moving downward from a state when the claw is at the initial position, thereby resulting in a transition of the claw from the initial position to the locking position.

5. The connector for temporary scaffolding according to claim 1, wherein the wedge body includes a protruding step portion engageable with a lower end of the claw in a state when the claw is at the initial position.

6. The connector for temporary scaffolding according to claim 1, wherein the locking body swings as a result of the wedge-body's moving downward from a state when the claw is at the initial position.

7. The connector for temporary scaffolding according to claim 1, wherein the biasing body is formed of an elastic member.

* * * * *